US005816170A

United States Patent [19]

Lopez Gomez et al.

[11] Patent Number: 5,816,170

[45] Date of Patent: Oct. 6, 1998

[54] TRACTOR BOGIE WITH INCORPORATED GAUGE-CHANGE SYSTEM

[75] Inventors: Jose Luis Lopez Gomez; Manuel Fernandez Benitez; Antonio Garvia Hierro, all of Madrid, Spain

[73] Assignee: Patentes Talgo S.A., Madrid, Spain

[21] Appl. No.: 824,571

[22] Filed: Mar. 26, 1997

[30] Foreign Application Priority Data

Aug. 14, 1996 [ES] Spain ..... 9601807

[51] Int. Cl.[6] ..... B61F 7/00

[52] U.S. Cl. ..... 105/178; 464/158

[58] Field of Search ..... 105/34.1, 178; 464/158, 159, 179, 183

[56] References Cited

U.S. PATENT DOCUMENTS

| | | | |
|---|---|---|---|
| 1,302,925 | 5/1919 | Holmes | 105/178 |
| 2,346,370 | 4/1944 | Eustis et al. | 105/178 |
| 2,978,885 | 4/1961 | Davison | 464/158 |
| 4,357,137 | 11/1982 | Brown | 464/159 |
| 5,546,868 | 8/1996 | Sugimoto et al. | 105/178 |

FOREIGN PATENT DOCUMENTS

| | | | |
|---|---|---|---|
| 0591088 | 4/1994 | European Pat. Off. . | |
| 0648659 | 4/1995 | European Pat. Off. . | |
| 1067576 | 5/1954 | Germany | 150/178 |
| 2078137 | 12/1995 | Spain . | |
| 2084551 | 3/1997 | Spain . | |

*Primary Examiner*—S. Joseph Morano
*Attorney, Agent, or Firm*—Ladas & Parry

[57] ABSTRACT

A tractor bogie with an integral gauge-change system which includes two frames which support sets of running gear and have sliding and centering blocks to support the bogie and unweight the wheels as they pass through a gauge changer; a toothed extendible axle arranged between each pair of sets of running gear; and a pinion/ring-gear transmission set fitted on the bogie frame to transmit the traction moment to the extendible axle. The invention is applicable to rolling stock adapted to run on tracks having two gauges.

5 Claims, 5 Drawing Sheets

TRACTOR BOGIE WITH INCORPORATED GAUGE-CHANGE SYSTEM

FIELD OF THE INVENTION

The present invention relates to a tractor bogie which incorporates a gauge-change system, specifically the TALGO system. The bogie includes sets of running gear which, as is customary in the Talgo gauge-change system, are each equipped with a wheel fixed by wedges to a short axle. The journals of the latter have individual roller bearings which are fixed by wedges, and whose its bearing-axle-boxes have externally incorporated, lugs by means of which, interacting with the rods of point locking bars, these sets of running gear are positioned on each of the two gauges.

BACKGROUND OF THE INVENTION

In patent ES-A-2,078,137, details are given of a system for locking the sets of running gear of a bogie and of the system which allows translation of said sets when the wheels are unweighted as they pass through a gauge changer. However, said Spanish patent applies solely to the case of hauled bogies and does not cover a gauge change in connection with tractor bogies.

In the case of axles for hauled stock, the wheels may be independent. This offers the fundamental advantage that the tendency of the wheel set to undergo a loop movement is eliminated, although, to prevent wear, it is necessary for the axles, or the bogies, where the latter are fitted, to be equipped with the corresponding guiding system. With guiding, it is also possible to reduce and even eliminate the positive striking angle of the wheels when curves are taken. A guiding system of this type is described in patent ES-A-2,084,551.

SUMMARY OF THE INVENTION

On the basis of the TALGO gauge-change system, the invention has created a novel tractor bogie whose sets of running gear may be displaced so that they can be adapted to the corresponding gauge. To this end, the bogie comprises two or more frames which each support two of said sets of running gear and are joined to the actual frame of the bogie via elastic elements constituting the primary suspension of the bogie, each support frame of the sets of running gear being equipped with sliding and centering blocks intended for supporting the bogie and unweighting the wheels as they pass through the gauge changer.

The support frames of the sets of running gear guarantee that the gap between both wheels of the sets of running gear will not vary and that the said wheels are parallel when they are positioned on each of the two gauges. The sliding and centering blocks guarantee that the frame dose not move in the transverse direction on the gauge changer, which is necessary to achieve unlocking and subsequent locking of the locks of the sets of running gear and also the correct transfer of the latter.

In order to achieve a railroad wheel set's inherent characteristic automatically centering itself on the track, which considerably reduces wear of the wheel flanges and also improves its holding on the track, a toothed extendible axle has been incorporated between the sets of running gear. This allows axial displacement of these sets with respect to one another but prevents relative rotation of the wheels, and this also offers the advantage—in this case in which traction is also applied to the wheels—of said traction being applied to both wheels with the consequent advantage of fully exploiting the adhesion weight.

According to one embodiment of the invention, the said toothed extendible axle consists of a joining piece, at each end, secured to the extension of the journal of the respective wheel axle. This transmits the rotation of said journal to a protective tube and to an externally toothed tube secured to the previous tube. Between said joining piece and the protective tube, at each end of the extendible axle, there is a flexible disk which, in rotation, secures the wheel to said axle and also has the function of absorbing the small misalignments which may exist between the axles of both wheels, thereby acting as a universal joint.

The extendible axle is supplemented with an internally toothed tube which prevents relative rotation of said joining piece and said protective tube of both wheels, this internally toothed tube being the tube which ultimately makes both wheels secure in rotation.

In a second alternative embodiment, said toothed extendible axle also includes joining pieces and flexible disks identical to those of the first embodiment and there is also a protective tube secured to an externally toothed tube. In this second embodiment, a second internally toothed protective tube is also present.

The difference between both embodiments lies in the fact that, in the first one, there are two externally toothed tubes secured to the protective tubes whereas, in the first one, use is made of a single externally toothed tube.

In both embodiments, the bogie frame has pinion/ring-gear transmission sets fitted, one for each carrying frame of the sets of running gear.

In the first embodiment of the invention, the ring gear of each transmission set transmits the traction moment to the internally toothed tube via a hollow-axle transmission mechanism. This will allow both pieces to be shifted off center with respect to each other, this shift originating from the deformation of the primary suspension.

In the second embodiment of the invention, the ring gear of said transmission set again transmits the traction moment to the internally toothed tube via a hollow-axle mechanism. When the gap between the wheels varies, when this axle is displaced over a distance equal to half the difference between the gauges, the entire assembly of pinion/ring-gear set assembly will also be displaced, although said set could be positioned so that it is symmetrically off-center on both gauges.

BRIEF DESCRIPTION OF THE DRAWINGS

The invention will be more readily understood with the aid of the following description which refers to the attached drawings, in which.

DETAILED DESCRIPTION OF THE INVENTION

Figure 1:
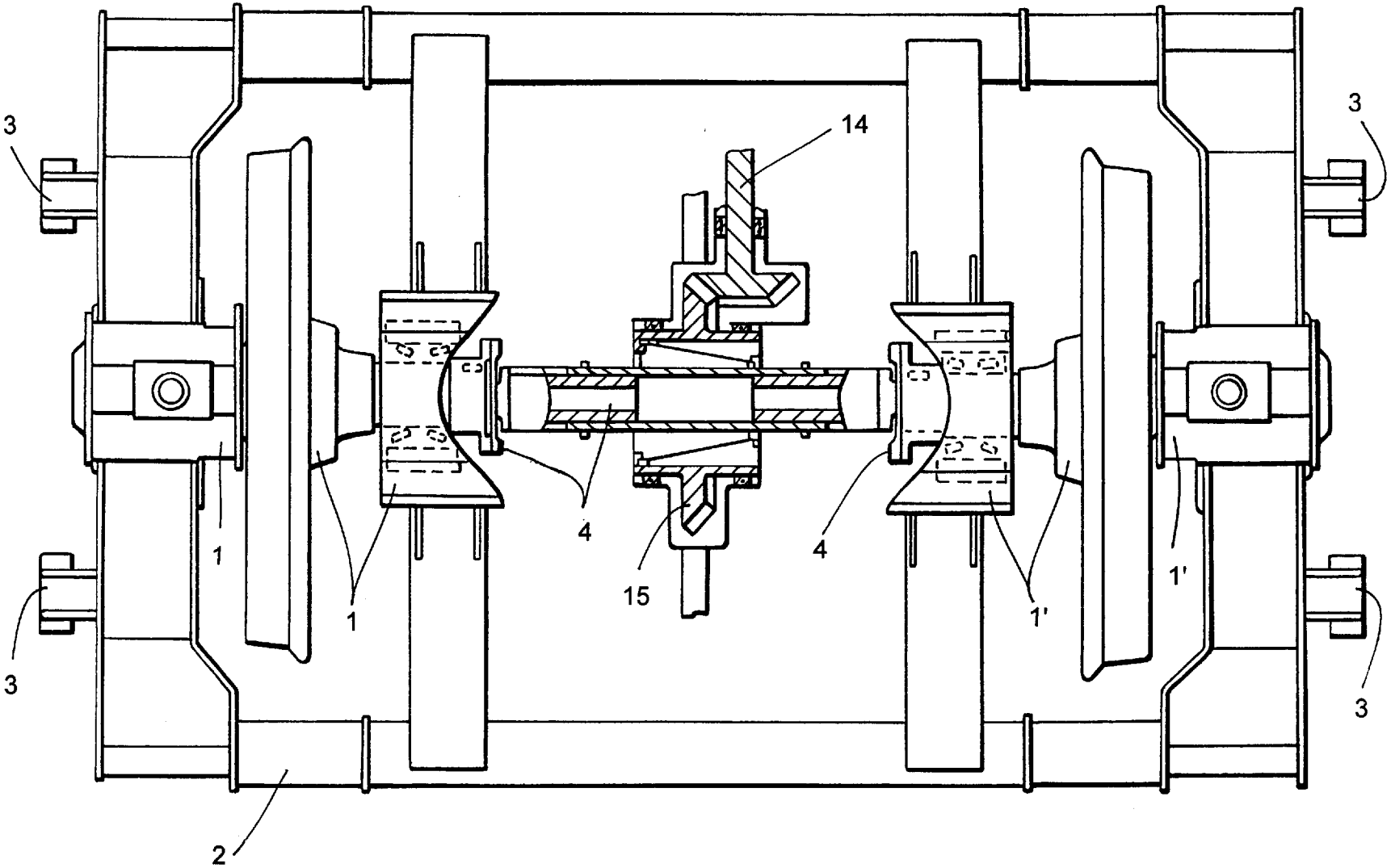
FIGS. 1 and 2 show an overall view of the first and second embodiments of the invention, respectively.
Figure 2:
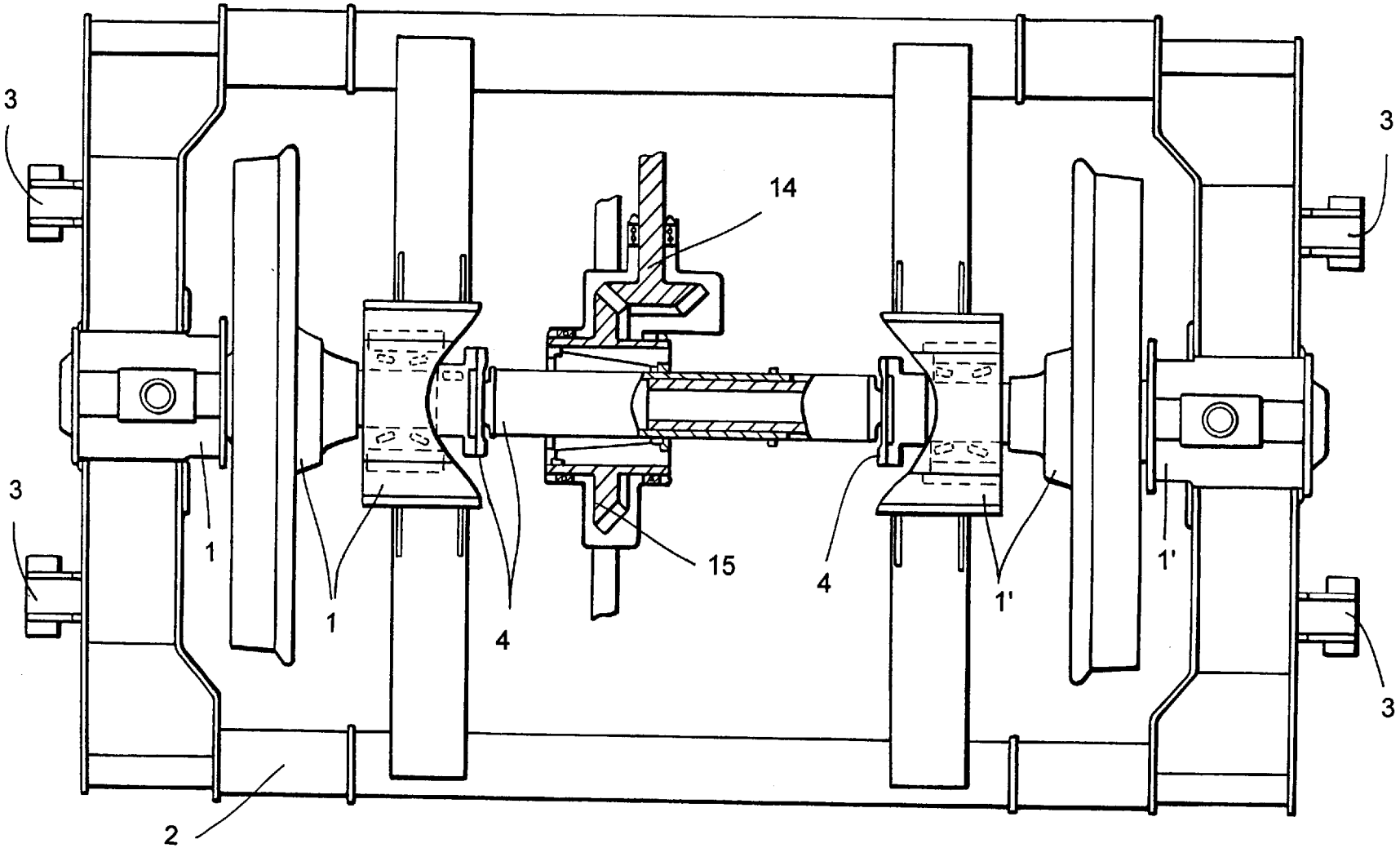

As shown in FIGS. 1 and 2, two sets of running gear 1 and 1' are integrated into a frame 2. For reasons of simplification, the drawings show a frame 2 of the type which is an underframe with cross members, but the requirements of the invention could also be fulfilled by integrating the sets of running gear into a bracing system which is different from the frame 2 illustrated.

The bogie illustrated incorporates two frames 2, each of which is joined to the actual bogie frame via elastic elements constituting the bogie's primary suspension. In addition, each of said frames 2 is equipped with sliding and centering blocks 3 designed to allow unweighting of the wheels as they pass through a gauge changer, this situation being necessary to allow transfer of the wheels from one gauge to the other.

To prevent relative rotation of the wheels of both sets of running gear 1, 1', a toothed extendible axle system 4 is incorporated between said sets.

Figure 3:
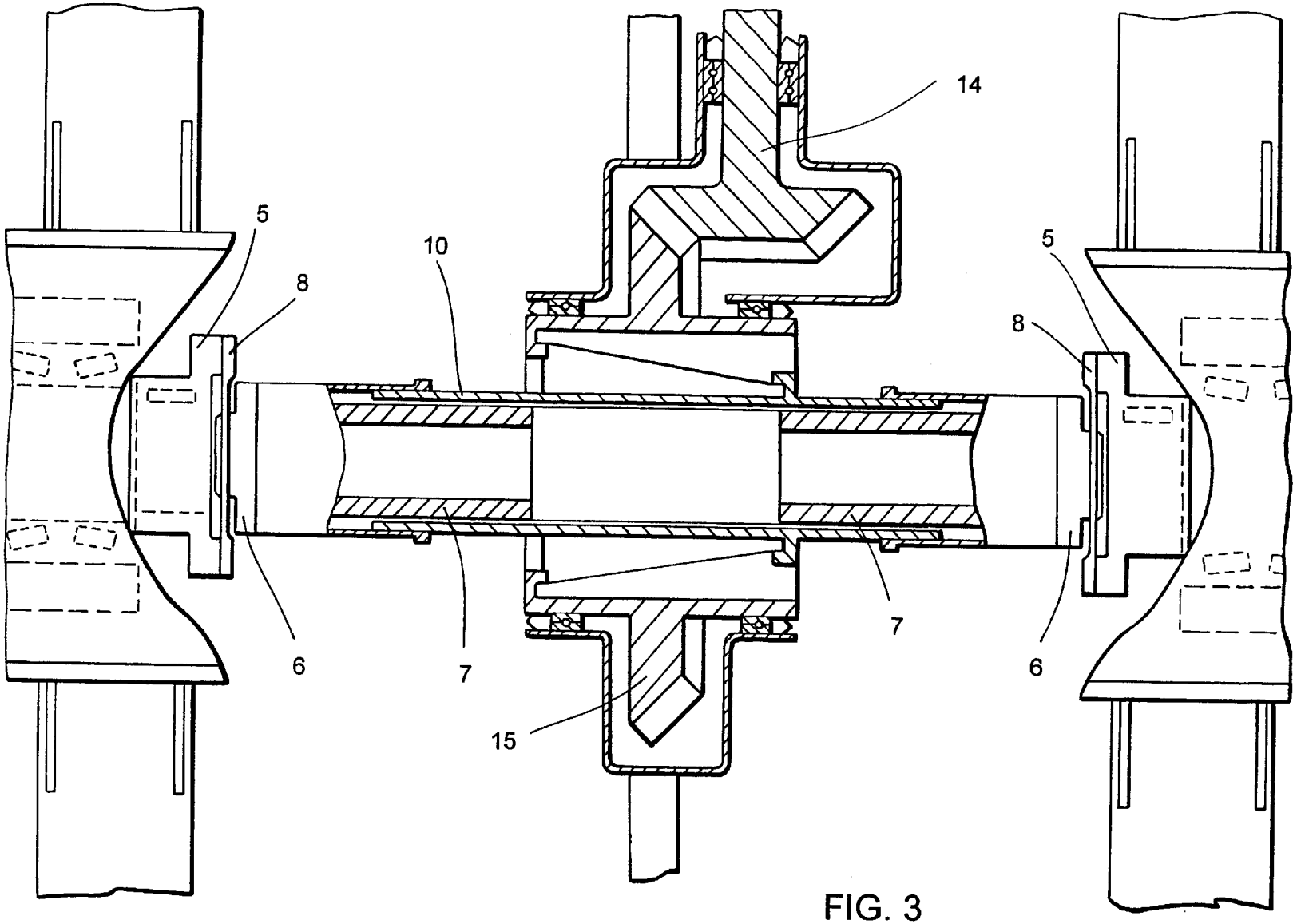
FIGS. 3 and 4 illustrate the embodiment of FIG. 1 in greater detail.
Figure 4:
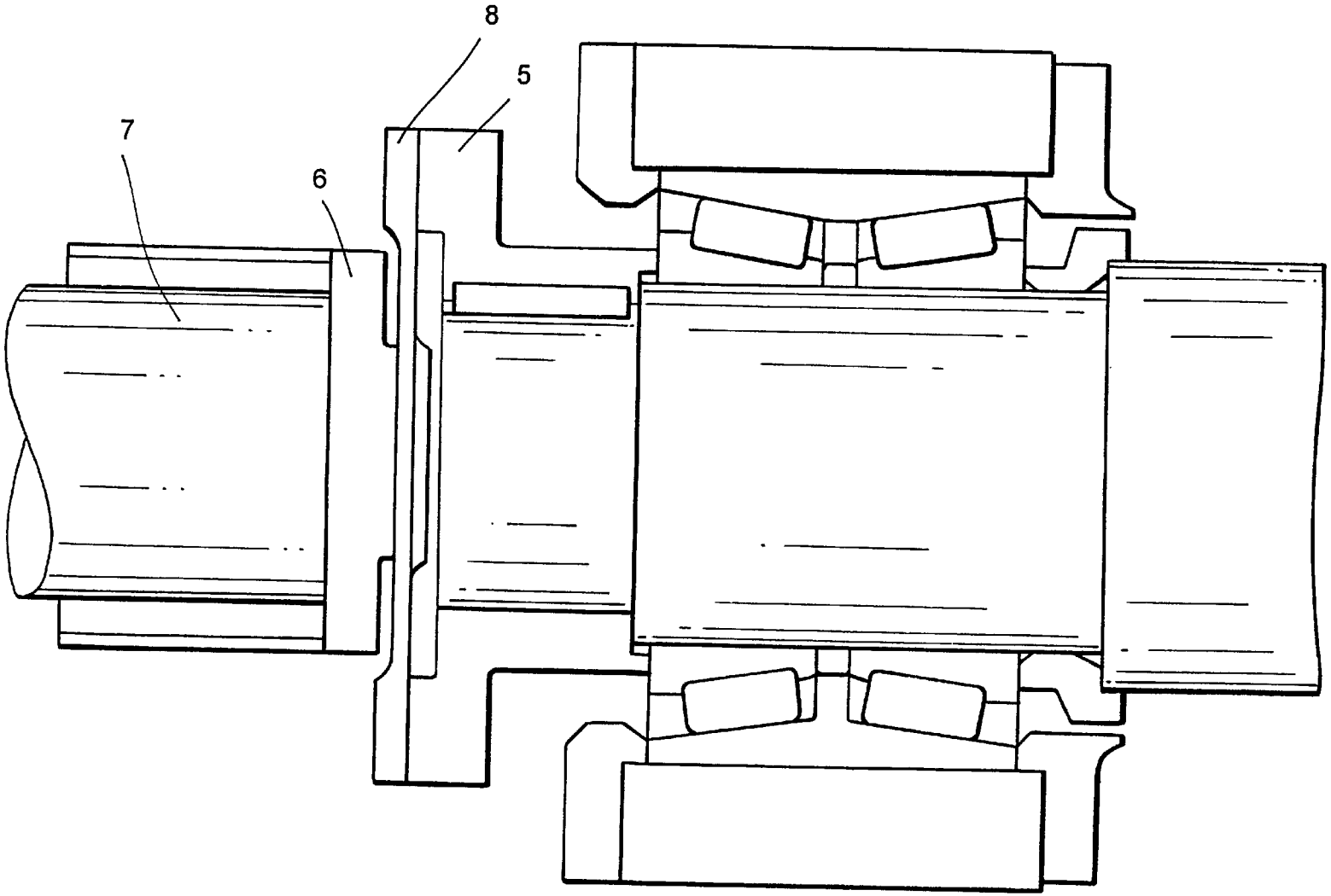

According to FIGS. 3 and 4, said axle 4 consists, at each end, of a joining piece 5 which is secured to the extension of the journal of the respective wheel axle and which transmits the rotation of said journal to a protective tube 6 and to an externally toothed tube 7 secured to the tube 6.

Between each joining piece 5 and the corresponding protective tube 6 there is a flexible disk 8 which in rotation, secures the wheel to the extendible axle 4 and which also has the function of absorbing the small misalignments which may exist between the axles of both wheels, said disk 8 thereby acting as a universal joint.

The toothed extendible axle 4 also includes an internally toothed tube 10 which prevents the relative rotation of the joining piece 5 and the protective tube 6 of both wheels. It is therefore the tube 10 which ultimately makes both wheels secure in rotation.

Figure 5:
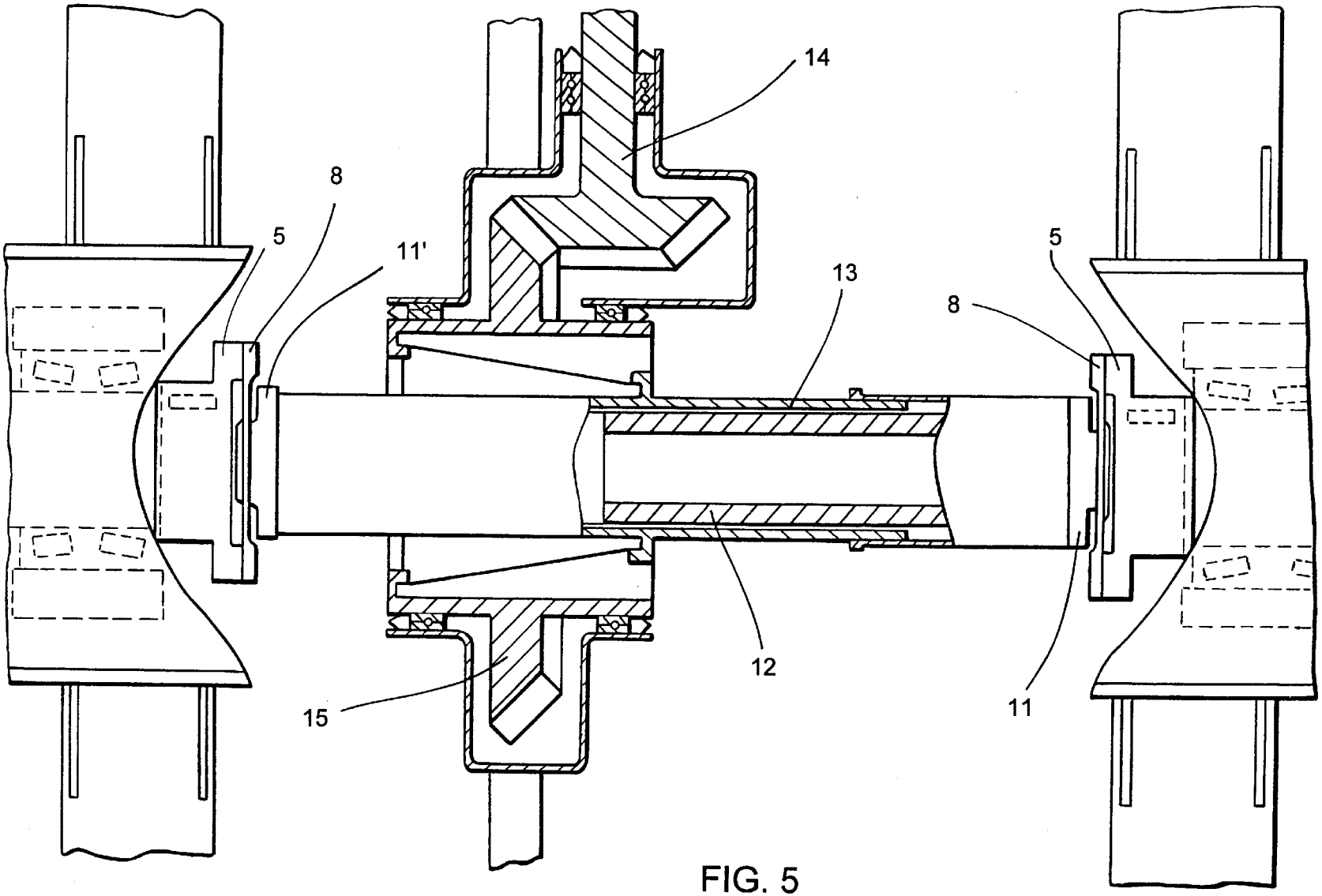
FIG. 5 is a detailed view of the embodiment of FIG. 2.

According to FIG. 5, the toothed extendible axle 4 includes, at each end, a joining piece 5 identical to that illustrated in FIGS. 3 and 4, as well as a flexible disc 8 which is also identical to the disks 8 of FIGS. 3 and 4.

In FIG. 5, in addition to a protective tube 11 secured to an externally toothed tube 12, it is possible to see a second protective tube 11' which has toothing on its inside. An internally toothed tube 13 is inserted between both tubes 11, 11'.

As may be observed, in FIG. 5 there is a single externally toothed tube 12, whereas in FIGS. 3 and 4 use is made of two externally toothed tubes 7.

The extendible axle system 4 incorporates a pinion/ring-gear transmission set 14, 15 which enables a variable-width railroad axle to be additionally converted into a tractor axle. This set is fitted on the bogie frame.

As may be observed in FIG. 3, the ring gear 15 transmits the traction moment to the internally toothed tube 10 via a hollow-axle transmission mechanism which will allow both pieces to be shifted off-center with respect to each other, this shift originating from the deformation of the primary suspension.

Moreover, as may be seen in FIG. 5, the ring gear 15 transmits the traction moment to the internally toothed tube 13 also via a hollow-axle mechanism. When, in this case, the gap between the wheels varies, when the extendible axle 4 is displaced over a distance equal to half the difference between the gauges, the entire assembly of the pinion/ring-gear set 14, 15 will also be displaced, although said set could be positioned so that it is symmetrically off-center on both gauges.

As a consequence of the development of the invention, it will now be possible for the gauge change to be applied not only to hauled rolling stock but also to tractor or locomotive front sections. This will avoid the need for external locomotives to push and/or haul a train whilst gauge-change operations are being carried out.

Although the above description referred to two-axle bogies, the invention could obviously be applied also to tractor stock with bogies with more than two axles. It would also be applicable to tractor stock with rigid axles instead of semiaxles joined together in an articulated manner. For this reason, the scope of the invention is claimed to be limited solely by the content of the attached claims.

What is claimed is:

1. A tractor bogie with an incorporated gauge-change system which includes sets of running gear each consisting of a wheel fixed to a short axle, the short axles of the sets of running gear having journals with individual roller bearings and bearing-axle-boxes including, lugs which, interacting with rods of point locking bars, position each running gear set on each of two gauges, said system comprising frames which each support two of said sets of running gear joined to a frame of the bogie via elastic elements constituting a primary suspension of the bogie, each frame being equipped with sliding and centering blocks intended for supporting the bogie and unweighting the wheels as said wheels pass through a gauge changer; a toothed extendible axle which is arranged between each pair of sets of running gear and which includes two end joining pieces secured to an extension of the journal of the respective wheel axles, two protective tubes to which the rotation of the journal of the axles of the wheels is transmitted via said end joining pieces, at least one externally toothed tube secured to said protective tubes, two flexible end disks which are fitted between an end joining piece and the corresponding protective tube and which, in rotation, secure the wheels to the extendible axle, and an internally toothed tube which prevents relative rotation of the joining pieces and the protective tubes of both wheels of each running gear set; and, for each frame, a pinion/ring-gear transmission set fitted on the bogie frame to transmit a traction moment to the internally toothed tube via a hollow-axle transmission mechanism.

2. The tractor bogie as claimed in claim 1, which comprises two of said frames.

3. The tractor bogie as claimed in claim 2, wherein each said frame has a configuration in the form of an underframe with cross members.

4. The tractor bogie as claimed in claim 1, wherein the extendible axle incorporates two externally toothed tubes.

5. The tractor bogie as claimed in claim 1, wherein the extendible axle incorporates a single externally toothed tube and the tube has internal toothing.

* * * * *